US005613333A

United States Patent [19]

Witzig, Jr.

[11] Patent Number: 5,613,333

[45] Date of Patent: Mar. 25, 1997

[54] MOTORIZED SKYLIGHT ASSEMBLY FOR MOUNTING ON THE ROOF OF A BUILDING

[76] Inventor: Michael J. Witzig, Jr., 616 Wallach, Eureka, Mo. 63025

[21] Appl. No.: 306,940

[22] Filed: Sep. 16, 1994

[51] Int. Cl.[6] ..... E04B 7/18

[52] U.S. Cl. ..... 52/200; 52/207; 52/220.8; 52/745.16; 49/413

[58] Field of Search ..... 52/22, 66, 200, 52/207, 220.8, 745.15, 745.16; 296/216, 221; 49/404, 413

[56] References Cited

U.S. PATENT DOCUMENTS

| | | | |
|---|---|---|---|
| 2,095,323 | 10/1937 | Marino . | |
| 3,090,613 | 1/1959 | Bechtold | 52/200 X |
| 3,815,299 | 6/1974 | Sorensen et al. . | |
| 4,229,037 | 10/1980 | Vermeulen | 296/216 |
| 4,610,116 | 9/1986 | Schulz . | |
| 4,663,905 | 5/1987 | Schulz . | |
| 4,726,156 | 2/1988 | Cousino . | |
| 4,848,051 | 7/1989 | Weisner et al. . | |
| 4,892,351 | 1/1990 | Ono et al. . | |
| 4,916,872 | 4/1990 | Young . | |
| 5,035,091 | 7/1991 | Ebato . | |
| 5,094,040 | 3/1992 | Bunka . | |
| 5,197,779 | 3/1993 | Mizuno et al. . | |

*Primary Examiner*—Christopher T. Kent

*Attorney, Agent, or Firm*—Polster, Lieder, Woodruff & Lucchesi, L.C.

[57] ABSTRACT

An automatic window assembly for installation in the roof of a building. The automatic window assembly is motorized and has a window pane that slides or tilts open or closed. The window assembly is mounted in an opening cut into the roof by attachment to an elongated template which is mounted on the roof and surrounds the opening. The template has a material thickness considerably less that that of the roof and has an opening formed in one end sized to accommodate the window pane. The template is positioned over the opening in the roof to provide the window pane opening at one end and an area of reduced material thickness at the other end. When the window is moved to an open position, the moveable pane slides under the template. A preformed and prefinished chute extends from the window to the ceiling of the room to allow with window to communicate with the room.

10 Claims, 5 Drawing Sheets

MOTORIZED SKYLIGHT ASSEMBLY FOR MOUNTING ON THE ROOF OF A BUILDING

BACKGROUND OF THE INVENTION

This invention relates generally to windows and, more specifically, to an automatic skylight mountable in the roof of a home.

Skylight windows are known to the art. Generally such windows are flamed into the roof of a house at the time of new home construction. Most of the conventional skylights have manual opening systems. A crank handle, as provided with conventional casement windows, is rotated to open the skylight to allow in fresh air or provide ventilation. Since conventional skylights are mounted high in the ceiling, an elongated rod or the like is used to access the crank handle. This method of opening a skylight window is cumbersome and discourages the homeowner from using the ventilation features of the conventional casement style skylight.

There are other drawbacks associated with conventional casement style skylights. First, they are generally mounted in a substantial casement frame that rises above the profile of the roof. This design makes the skylight window particularly conspicuous and unsightly. Second, such windows are prone to leaks. Indeed, one of the reasons that these windows employ the high profile casement is to prevent pooling of water over the window and help prevent leaking. Finally, conventional casement windows are difficult and time consuming to retrofit in an existing home. They require substantial modification of the roof line. Furthermore, if the skylight is mounted in a roof having substantial pitch and attic space, a tunnel or conduit of some sort must be constructed from the skylight to the ceiling of the room over which it is mounted. This requires that walls be constructed and finished to form an aesthetically pleasing structure visible from the room. This procedure is labor intensive and increases the cost of mounting the skylight in the roof. Furthermore, retrofitting with a skylight increases the risks of leaking around the window.

Sunroofs or moon roofs for automobiles also are known. These particular roofs basically are windows mounted in the automobile roof to allow in more light and, in the case where the window opens, additional ventilation. Automobile sun roofs are provided in manual opening or "pop-up" styles as well as a powered style. The "pop-up" style has a hinge mechanism and one side of the pane lifts up to create an opening for ventilation, The powered design employs a small electric motor that moves the window pane into a tilted position for slight ventilation or moves the pane completely out of the frame to provide a larger open space above the driver and passengers. Such roofs or, more accurately, such window assemblies generally are provided as a kit having a mounting frames, movable pane, motor drive, drainage system and trim. They are relatively inexpensive, easy to install, and operate automatically to provide good ventilation. In short, they have all the attributes desirable in a roof mounted skylight for a building. Heretofore, no one has been able to properly retrofit such an automobile type sunroof into the ceiling of a house or other building. Since the roof of a house, for example, has a significantly greater material thickness than an automobile roof, it was, up to this time, virtually impossible simply to mount a sliding window or automobile-type sun roof in a house. The material thickness of the roof of the building interferes with the operation of the sliding window. That is, there is not enough clearance to allow the window pane to slide under the roof into an open position. This arrangement also places the thickness of the wood and shingles below the roof line allowing water to pool in the skylight hole.

SUMMARY OF THE INVENTION

It is, therefore, among the principal objects of the present invention to provide an automatic window assembly that is mountable in the roof of a house or building to function as an openable skylight in the building.

It is another object of the present invention to provide a metal template that mounts over a opening in the roof of a building and serves to reduce the material thickness of the roof to allow the automatic window assembly to be flush mounted and to open and close properly when mounted in the roof of a building.

It is yet another object of the present invention to provide such an automatic window assembly in a kit having a motorized window assembly, a metal template, and a prefinished chute that extends from the window assembly into the room to provide visual access from the room to the window.

Still another object of the present invention is to provide such a kit that is economical to manufacture, self-contained and easy to install in an existing home or building.

The invention, generally stated, comprises an automatic window assembly for installation in the roof of a building. The automatic window is motorized and has a window pane that slides or tilts open and closed. The window assembly is mounted in an opening cut into the roof by attachment to an elongated metal template that is mounted on the roof and surrounds the opening. The template has a material thickness considerably less than that of the roof and has an opening formed in one end sized to accommodate the window pane. The template is positioned over the opening in the roof to provide a window pane opening at one end and an area of reduced material thickness at the other end. When the window is moved to an open position, the moveable pane can slide under that end of the template. A preformed and prefinished chute of appropriate dimensions extends from the window to the ceiling of the room to allow the window to communicate with the room. The prefabricated chute eliminates the need to construct a framed structure between the roof and the ceiling of the room. The window is powered by an AC converter with a battery backup.

DESCRIPTION OF THE PREFERRED EMBODIMENT

Figure 1:
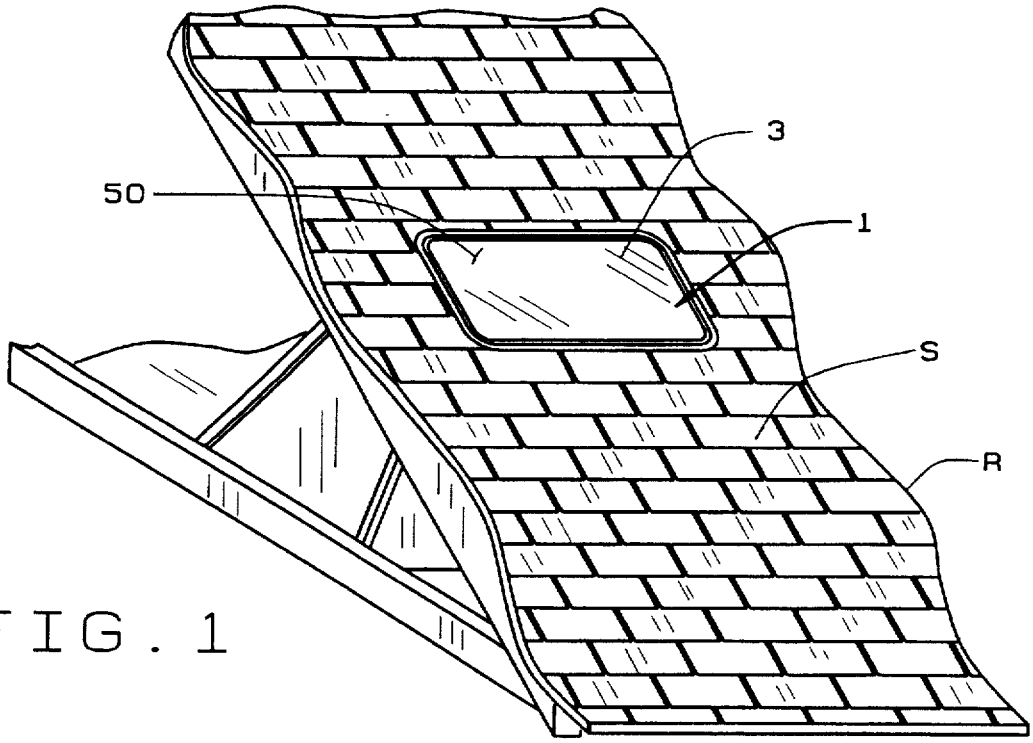
FIG. 1 is a fragmentary perspective view of the automatic window assembly of the present invention shown mounted in a roof, partially cut away.
Figure 2:
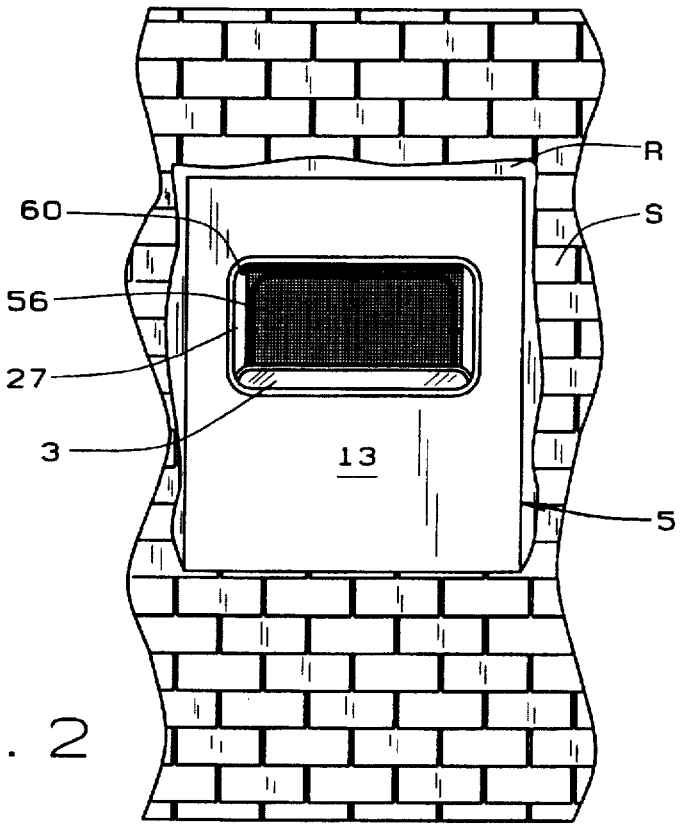
FIG. 2 is a fragmentary top plan thereof.

The automatic window assembly of the present invention is indicated generally by reference numeral 1 in the drawings. As can best be seen in FIGS. 1 and 2, the assembly 1 is flush mounted in the roof R of a building. Once installed, as will be described below, the assembly 1 is sealed and surrounded with shingles S or other appropriate roof sealing material so as to be relatively inconspicuous. The assembly 1 has a moveable transparent window pane 3. FIG. 1 shows the pane 3 in a first or closed position. In this position the pane 3 allows light into the room over which the assembly is mounted. FIG. 2 shows the pane 3 in a second or open position which allows for ventilation of the room. Also, the pane 3 can be tilted open (3A, FIG. 6). The various elements of the assembly 1 will now be described in greater detail.

Figure 4:
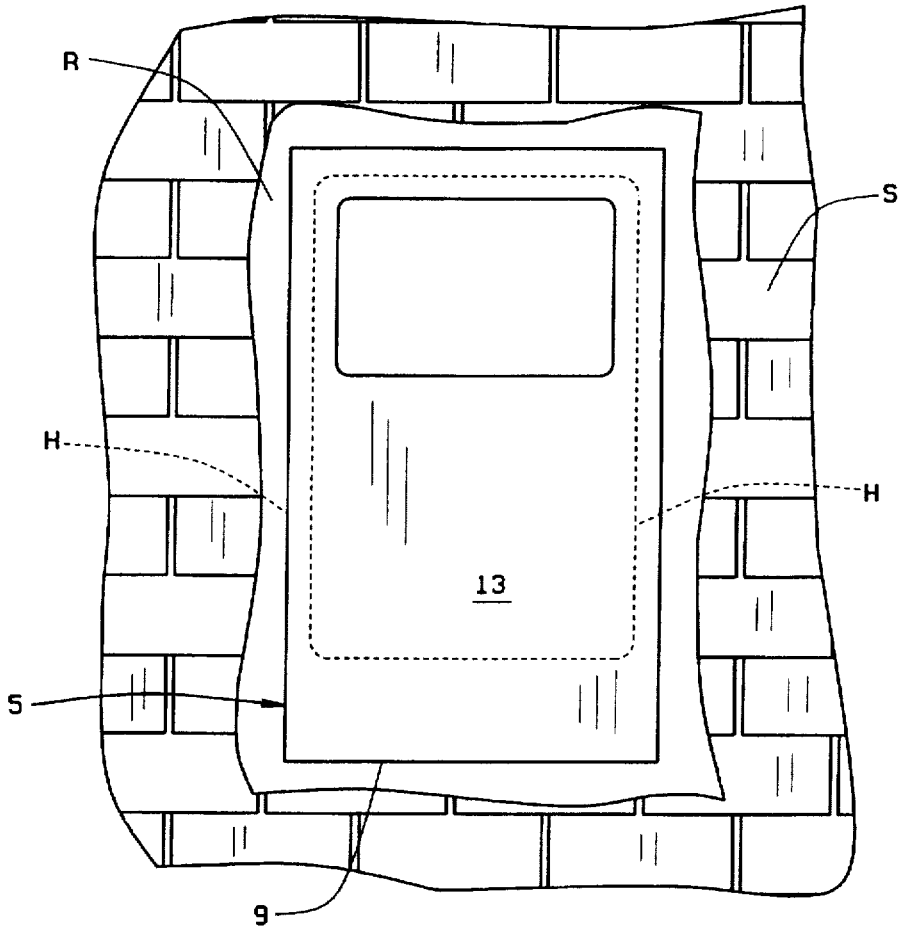
FIG. 4 is a fragmentary top plan of the template positioned over a opening in the roof.
Figure 3:
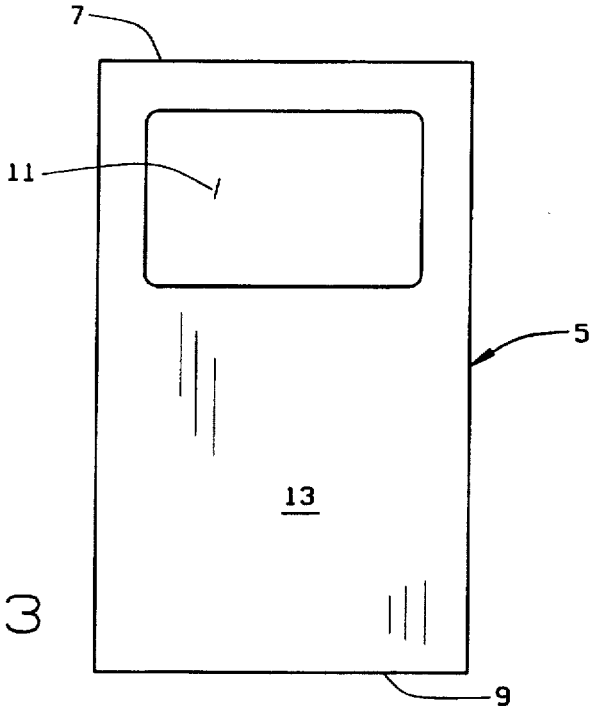
FIG. 3 is a top plan of the template.
Figure 5:
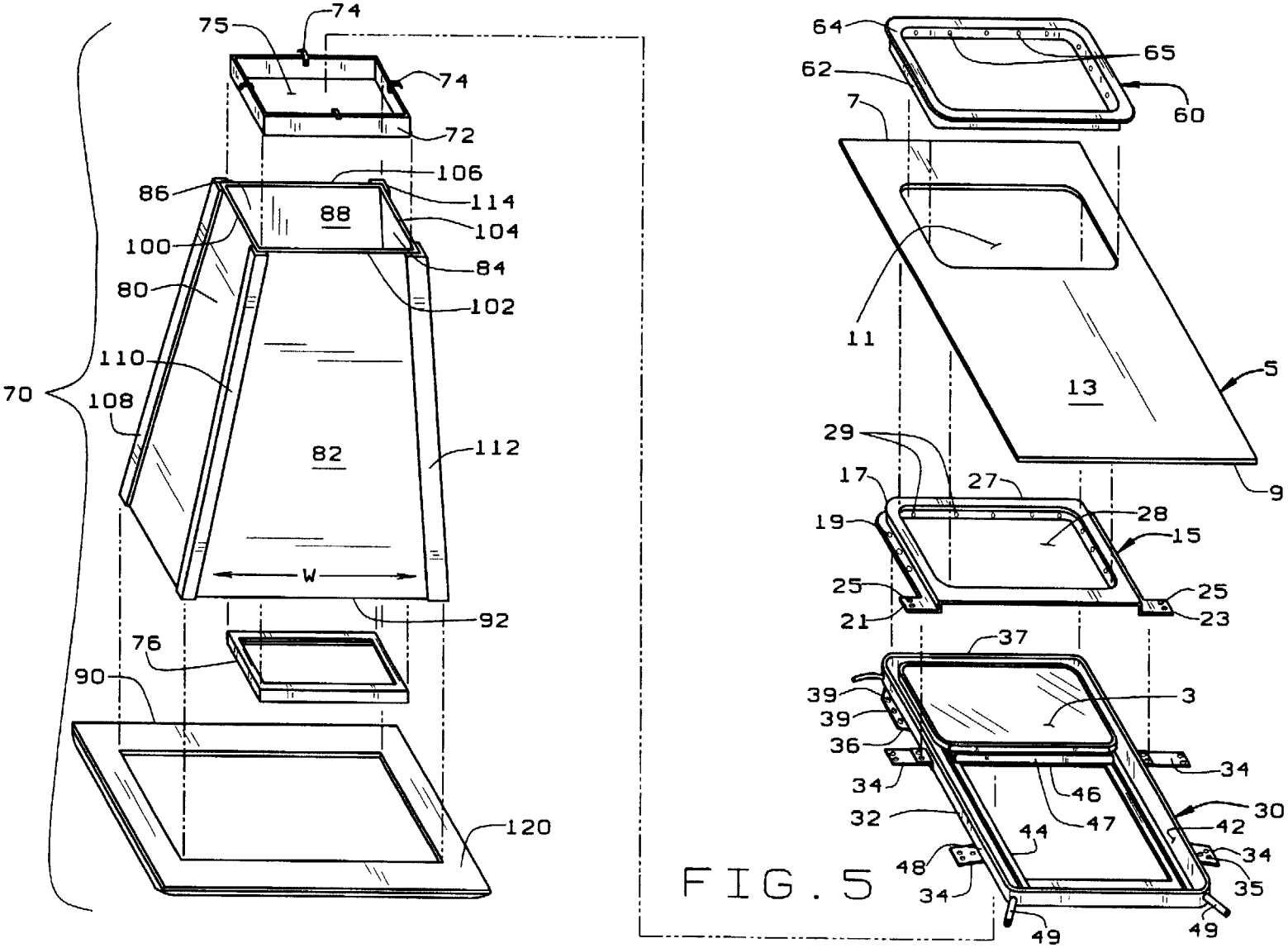
FIG. 5 is an exploded view of the automatic window assembly.

The assembly 1 contains a mounting template 5. The template 5, as shown in FIG. 3, has a generally elongated rectangle configuration. The template is relatively thin, preferably being 16 to 20 gauge galvanized sheet metal. The template 5 has a first end 7 and a second end 9. A rectangular opening 11 is formed in the template adjacent a first end 7. There is a flat expanse of template material or web 13 adjacent a second end 9. A best seen in FIG. 4., the template 5 is dimensioned to fit over a opening H cut into the roof of a building at the point where the window is to be positioned in the roof. The opening H is approximately three-fourths (¾) the length of the assembly 1. The template 5 serves to reduce the material thickness of the roof R around the opening H. The opening 11 in the template 5 is dimensioned to allow the pane 3 to be positioned in the opening 11. The web 13 is dimensioned to allow the pane 3 to recede thereunder when in the second position, as will be explained in greater detail below. The template 5 preferably is constructed from a strong, weather-resistant material such as galvanized metal. However, any appropropriate strong, weather-resistant material can be used.

The template 5 is positioned over the opening H and appropriately attached to the roof with screws, nails or the like. Furthermore, the template 5 can be glued, caulked and appropriately sealed to the roof. It should be noted that the template 5 is positioned so that opening 11 is square with the lines of the roof. Since the template 5 covers the edges of the opening H and, in effect creates a new opening, the template 5 can be positioned squarely even if the opening H is not cut evenly or square with the roof.

An inner mounting ring 15 is attached to the bottom side of the template 5 and to the adjacent roof R. The inner ring 15 has a peripheral mounting flange 17 with a plurality of screw holes, as at 19 (FIG. 8), formed therein. There are mounting brackets 21 and 23 on opposite sides of the flange 17. A plurality of mounting holes 25 are formed in the brackets 21 and 23 to allow attachment to the roof with screws or other appropriate means. The body 27 of the ring 15 is elevated above the flange 17 and dimensioned to fit snugly inside the opening 11 of the template 5. The body 27 defines an aperture 28 dimensioned to frame the pane 3. There are a plurality of rivet holes 29 through the inside edge of the flange 17 for attachment of a top ring as will be explained.

Figure 8:
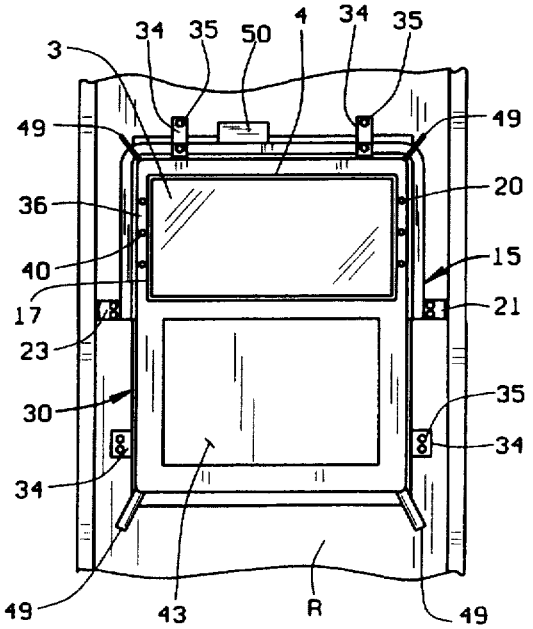
FIG. 8 is a fragmentary cross-sectional view taken along lines 8—8 of FIG. 9.

A motorized window pane assembly 30 is mounted under the ring 15 and the template 5 (FIG. 8). The assembly 30 has a generally elongated frame 32. The frame 32 has a plurality of mounting brackets 34 with holes 35 formed therein for the attachment to the roof. A mounting flange 36 extends outwardly from the frame 32 at a first or top end 37 and has a plurality of holes 39 formed therein. The holes 39 align with the holes 19 in the flange 17 to allow attachment of the assembly 30 to the ring 15 with screws 40 or other appropriate means. The frame 32 has a vertical wall segment 42, a flat or horizontal wall segment 44, and a cross member 46. A recess or trough 48 is formed in the horizontal wall 44 to collect water and direct it to a drain tube 49. The drain tubes 49 are as long as required and, in the preferred embodiment, extend through the eaves and empty into the guttering. The walls 42 and 46 define a track for the movement of the window pane as will now be explained. A movable water trough 47 designed to move with the window pane within the track collects water and diverts it to trough 48 for collection.

Figure 9:
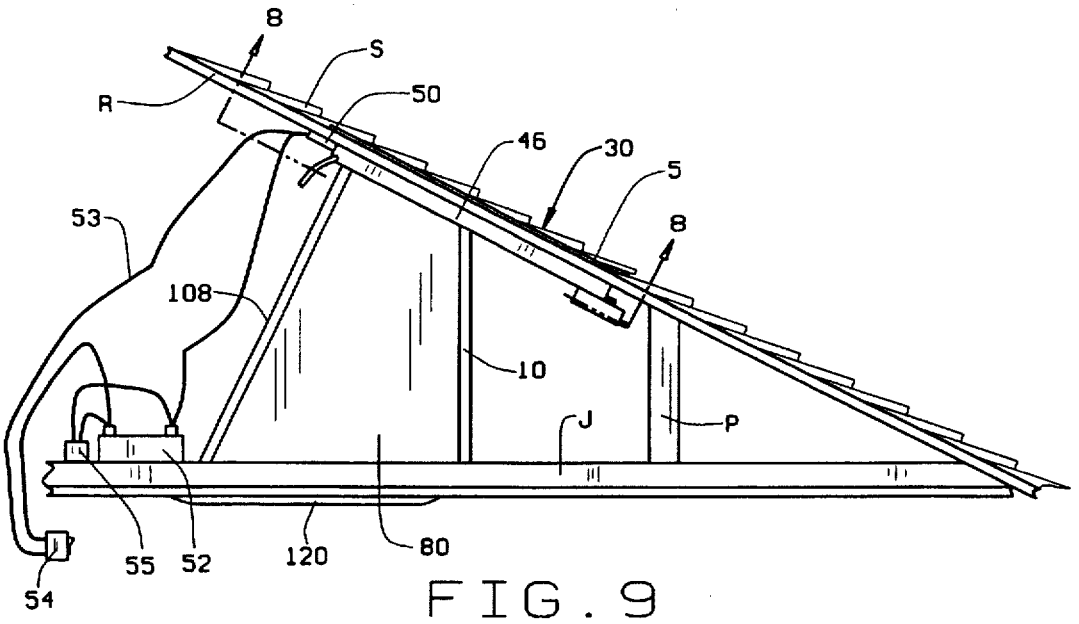
FIG. 9 is a fragmentary side elevational view of the automatic window assembly of the present invention.

The movable pane 3 is slidably mounted within the frame 32. A conventional 12 volt electric motor 50 powers the window pane to move back and forth in the frame 32. As best seen in FIG. 9, motor 50 is powered by AC converter 52, via conventional wiring 53. The converter 52 is plugged into a conventional wall outlet (not shown) with a cord and plug assembly 54 or directly wired. The AC converter can be a conventional battery charger. Furthermore, the power source can have a 12 volt battery 55 as a backup or emergency power source. The converter 52 should be wired with a fused power line to battery 55 to provide a constant trickle charge to keep the battery 55 fully charged. In the event of a power failure, for example a storm, the battery will allow closing of the window pane. It should be noted that an optional screen 56 is appropriately attached to the pane 3. The screen 56 is on a conventional spring tension roller so that it will unwind when the pane 3 moves to the second or open position and rewind when the pane 3 moves to the first or closed position.

A top or finish ring 60 seals the outside of the assembly. The ring 60 has an inner ring 62 dimensioned to fit snugly into the opening 11 and engage aperture 28. An outer flange 64 seats against the template 5 to seal the assembly. There is a plurality of rivets 65 through the inner ring 62 to attach the outer ring 60 to the inner ring 15 during assembly as will be explained below.

Figure 7:
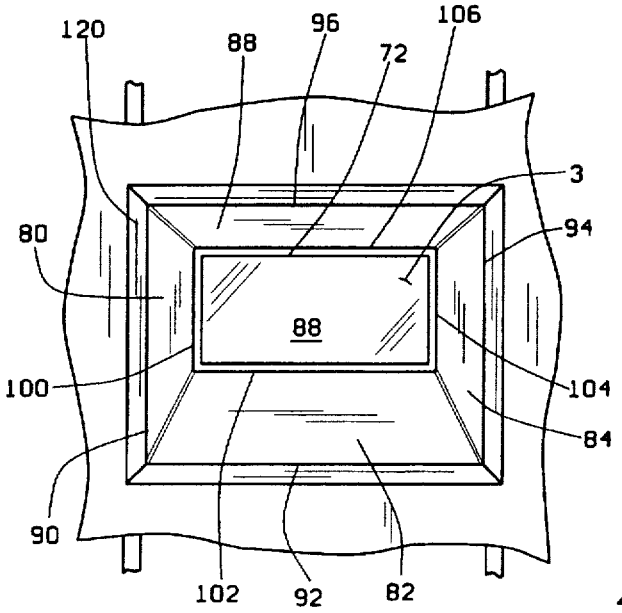
FIG. 7 is a fragmentary bottom plan of the automatic window assembly of the present invention mounted in a roof of a building.

The automatic window assembly of the present invention has a chute assembly, indicated generally by reference number 70. The chute assembly 70 functions both as a conduit of light and air and as a spacer between the window pane assembly and the ceiling of the room over which the window is mounted. In the event that the window assembly is mounted in the roof of a house having severely pitched roofs, there is considerable attic space between the roof and the ceilings. The chute assembly 70 extends from the roof to the ceiling. The chute assembly 70 has a first or attaching ring 72. The ring 72 has a plurality of brackets 74 to secure the ring 72 to the bottom side of the frame 32. The ring 72 defines an aperture 75 that is dimensioned to the frame pane 3 ( FIG. 7). The top ring 76 is dimensioned to fit in the ring 72 with enough clearance to allow wall panels in between. Four opposed wall panels 80, 82, 84, and 86 define a chamber 88. The upper ends of the respective wall panels are inserted in the ring 72 to hold the panels in proper position. The top ring 76 is then inserted up through the chute inside ring 72 and attached to stabilize the chute assembly. It will be appreciated that the respective panels can be of any size required by the specific application. Generally, the panels are trapezoidal in configuration. The respective bottom edges 90, 92, 94 and 96 are greater in length than the respective upper edges 100, 102, 104, 106. This allows for an aperture in the ceiling greater than the size of the pane 3 to maximize the illuminating and ventilating features of the window. The panels 80,82,84 and 86 generally are prefinished and do not require additional painting or plastering. The respective panels are joined together by four L-shaped corner braces 108, 110, 112 and 114. The respective braces are attached on the backsides of the respective panels with an appropriate adhesive or the like and are not visible inside the chamber 88 (FIG. 7). A bottom or finish ring 120 is appropriately attached to the bottom edges of the wall panels. The ring 120 secures the panels in position and serves to finish around the opening that must be cut in the ceiling of the room. The ring 120 can have a functional or decorative finish. Furthermore light sources (not shown) can be mounted on or recessed in the finish ring to enhance to appearance of the chute. It will be appreciated that the length L of the chute can be any desired length depending upon the application. The width W is limited only by the placement of the floor joists, as will be explained below.

Installation and use of the automatic window assembly of the present invention is relatively simple and inexpensive. First the shingles S are pulled back or removed to expose the sheathing of roof R. An opening should be marked on the outside and inside of the rook An opening H of appropriate dimensions is cut through the sheathing. The opening H should be cut between trusses. However, the ceiling joists are cut and capped, if necessary. The template 5 is positioned over the opening H so that the opening 11 is square with the roof line. A urethane seal may be placed between the template 5 and the roof R. It should be noted that the end 9 of the template 5 is placed over a row of shingles S (FIGS. 6) for a better seal. The template 5 is secured to the roof R with screws or other appropriate means. A seal is placed around outer ring 60 and the outer ring 60 is positioned in place on the template 5. The mounting ring 15 is then positioned in place under the template 5. The outer ring 60 is attached to the inner ring 15 with the rivets 65, sandwiching the template 5 in between the respective rings. This procedure secures the inner ring 15 in place for the attachment of the window assembly 30 and also creates a watertight seal. The window assembly 30 is secured to the mounting ring 15 and to the roof R. The chute assembly 70 is then attached. Support posts P are positioned between the roof R and joists J for additional support if desired. An opening is cut in the ceiling C. The ring 72 is appropriately attached to the window assembly 30. The panel walls 80, 82, 84 and 86 are inserted in the ring 72 The ring 76 is inserted in ring 72 and secured. The bottom edges 90,92,94 and 96 of the respective panels are positioned in the opening cut in the ceiling. The panel walls 80, 82, 84 and 86 are glued to the braces 112 and the bottom edges 90,92,94 and 96 are secured to the adjacent joists or rafters. The finish ring 120 is placed around the opening and secured to the respective panel edges. The window assembly is appropriately wired. The use of the chute assembly 70 allows for easy and quick installation. The chute assembly 70 eliminates the need for flaming and finishing a chamber from the window to the ceiling. The elements of the chute assembly 70 can be provided in various sizes and shapes depending upon the type of roof in which the window assembly is to be mounted.

Figure 6:
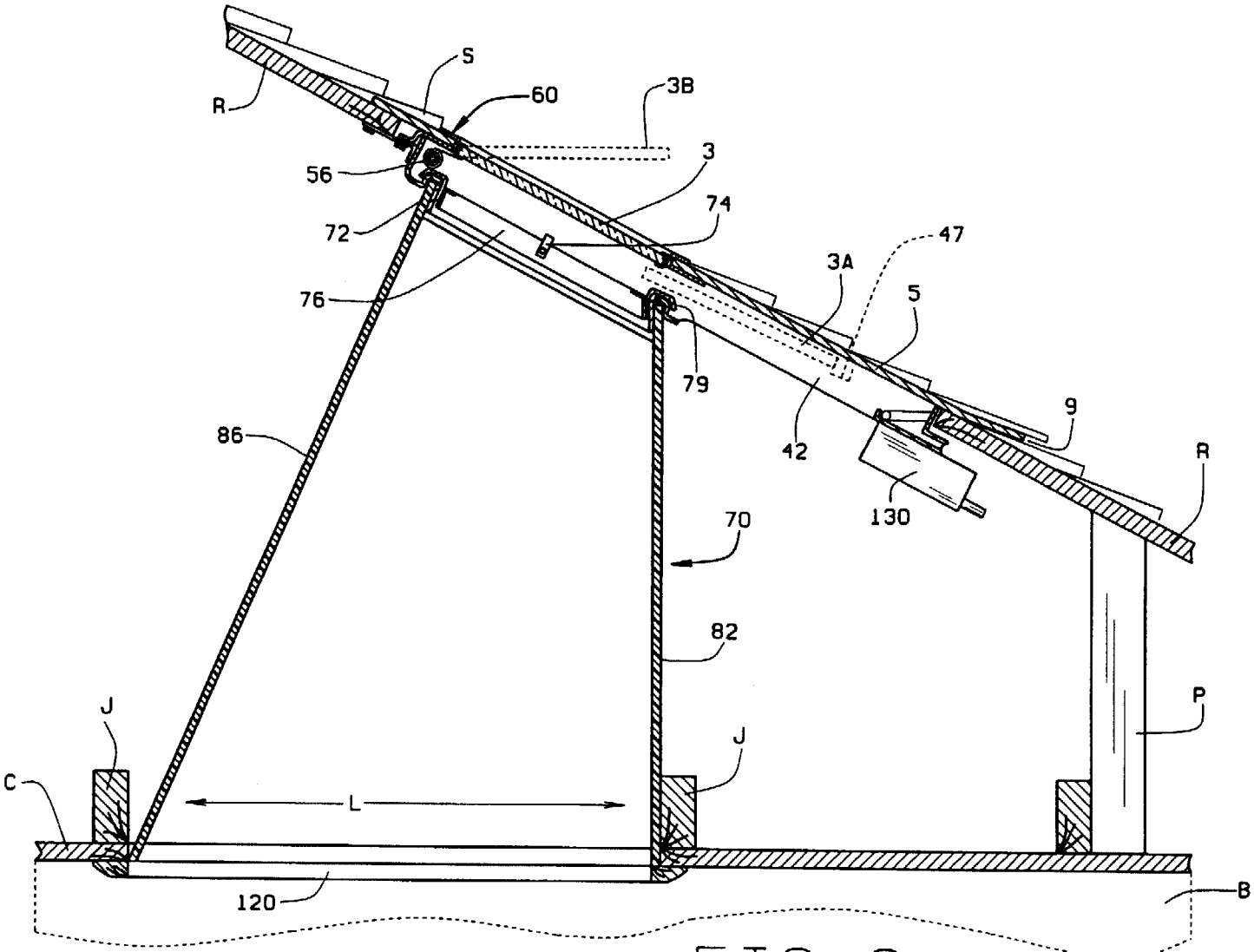
FIG. 6 is a fragmentary vertical section view of the motorized skylight of the present invention.

In use, the use can activate the motor 50 from a switch (not shown) mounted on the wall of the room. The user can move the window from the first or closed position to the second or open position. As shown in FIG. 6, the pane 3 moves within the frame 32 and recedes under the web 13 of the template 5. As stated above, the relatively small material thickness allows the pane 3 to recede thereunder.

It will be appreciated that various changes and modifications can be made in the automatic window assembly of the present invention without departing from the scope of the invention. For example, as shown in FIG. 6, an overflow drain pan 130 is employed. The pan 130 has a tubing which drains to the guttering as previously described. However, the drain pan 130 can be equipped with a water level sensor that can inform the user of a failure to drain. The foregoing description and accompanying drawings are intended to be illustrative only and should not be viewed in a limiting sense.

What is claimed is:

1. A motorized skylight assembly adapted to be flush mounted in the roof of a building and adapted to communicate from the roof to a ceiling in the building comprising:

a flat elongated template having a first end and a second end, said template having an opening formed in the first end, said template constructed to mount over an opening cut in the roof, the template adapted to be substantially thin in relation to the thickness of the roof on which it is adapted to be mounted to thereby accommodate a window pane in an open position;

a motorized window pane assembly positioned beneath said template and adapted to be attached to the underside of said roof, said window pane assembly having a window pane movable from a first or closed position to a second or open position, said window pane being positioned under said second end of said template when moved to said second or open position; and a prefabricated chute adapted to extend from said window pane assembly to said ceiling in a room.

2. The template of claim 1 contructed of 16 to 20 gauge galvanized sheet metal.

3. A method of installing a motorized skylight assembly in a roof of a building comprising the steps of:

cutting an opening in the roof, said opening dimensioned to accommodate the skylight assembly;

placing a template over said opening, said template being generally flat and elongated and having an opening formed in a first end and a web at a second end;

attaching said template to the roof;

attaching a movable window pane assembly to an under side of said template, said window pane assembly having a movable window pane and a motor means for moving said window pane from a closed to an open position;

attaching a first end of a prefabricated chute to the roof; and attaching a second end of said chute to a ceiling in said building, said chute having four opposed sides defining a chamber that extends from said window pane assembly to the ceiling.

4. A building having a skylight in the roof comprising:

a roof;

a space within the building having a ceiling;

a skylight assembly in said roof, said skylight assembly comprising a template around an opening in said roof, a motor driven window assembly attached to said template and having a window pane that moves from a closed position to an open position, said window pane being positioned generally flush with said roof; and a chute means cooperatively connected to said window assembly and interposed between said assembly and said ceiling in the building.

5. An automatic window kit adapted to be flush mounted in the roof of a building comprising:

a template adapted to fit flush around an opening cut in the roof, said template being elongated and generally flat having a first end and a second end with an opening formed in said first end, said opening dimensioned to surround an opening in the roof of a building;

an automatic window assembly adapted to be positioned beneath the under side of said template and adapted to be attached to the under side of said roof, said automatic window assembly having a window pane movable from a closed position to an open position and an electric motor means for moving said window pane; and a prefabricated chute adapted to extend from the window pane to a ceiling in the building.

6. A skylight assembly for mounting in the roof of a building to allow for illumination and ventilation of an interior area of the building comprising;

a template adapted to fit over an opening in the roof, said template being generally elongated and flat having a first end and a second end and having an opening formed in said first end adapted to be positioned over the opening in the roof;

a motor driven window pane assembly having a window pane adapted to be moved from a first or closed position wherein the pane is positioned in the opening in the roof to a second or open position wherein the pane recedes under the second end of the template; and a prefabricated chute having a first open end attachable under the window pane assembly and a second open end adapted to terminate in a ceiling of the building to provide means of communication between the window assembly and the area.

7. The window assembly of claim 6 wherein said chute further comprises four opposed walls defining a chamber that allows light and air to communicate between the window assembly and the area.

8. A motorized skylight assembly adapted to be flush mounted in a roof panel of a building and adapted to communicate from the roof to a ceiling in the building comprising:

a flat elongated template having a first end and a second end, said template having an opening formed in the first end sized to accommodate a window pane of a motorized window pane assembly, said template constructed to mount over an opening formed in the roof panel whereby said template opening is aligned with and smaller than the roof panel opening; and a motorized window pane assembly positioned beneath the template opening, said window pane assembly having a window pane movable from a first or closed position beneath the template opening to a second or open position, said window pane being positioned under said second end of said template when moved to said second or open position, the window pane also being tiltable into the template opening;

the template adapted to be substantially thin in relation to the thickness of the roof on which it is adapted to be mounted to thereby accommodate the window pane in its open position;

the motorized window pane assembly having laterally extending brackets adapted to underlie the roof and having fastening means for attachment to the underside of the roof using said brackets.

9. The skylight assembly of claim 8 including a mounting assembly which includes:

a) an inner mounting ring attached to the window pane assembly and adapted to be positioned in the template opening, and b) a top finish ring connected to and fitting snugly within the inner mounting ring and sealingly connecting the inner ring, the finish ring, and the template at the periphery of the template opening.

10. The skylight assembly of claim 9 wherein the finish ring has an outer peripheral flange overlying the template to seal the template opening.

* * * * *

UNITED STATES PATENT AND TRADEMARK OFFICE

CERTIFICATE OF CORRECTION

PATENT NO. : 5,613,333
DATED : March 25, 1997
INVENTOR(S) : Michael J. Witzig, Jr.

It is certified that error appears in the above-indentified patent and that said Letters Patent is hereby corrected as shown below:

In column 1, line 10, please change "flamed" to "framed".

In column 5, line 24, please change "rook" to "roof.".

In column 5, line 57, please change "flaming" to "framing".

Signed and Sealed this

Seventh Day of October, 1997

*Attest:*

Bruce Lehman

BRUCE LEHMAN

*Attesting Officer*

*Commissioner of Patents and Trademarks*